US007762111B2

(12) United States Patent
Damikolas et al.

(10) Patent No.: US 7,762,111 B2
(45) Date of Patent: Jul. 27, 2010

(54) MULTI-PIECE PLUG ASSEMBLY FOR A CYLINDER LOCK

(75) Inventors: Gerry Damikolas, Upland, CA (US); Diane Sipes, Trabuco Canyon, CA (US)

(73) Assignee: Newfrey LLC, Newark, DE (US)

( * ) Notice: Subject to any disclaimer, the term of this patent is extended or adjusted under 35 U.S.C. 154(b) by 1031 days.

(21) Appl. No.: 11/189,672

(22) Filed: Jul. 26, 2005

(65) Prior Publication Data

US 2007/0022793 A1 Feb. 1, 2007

(51) Int. Cl.
*E05B 9/04* (2006.01)

(52) U.S. Cl. ..... 70/375; 70/492; 70/367

(58) Field of Classification Search ..... 70/367–375, 70/492, 495

See application file for complete search history.

(56) References Cited

U.S. PATENT DOCUMENTS

| | | | | | |
|---|---|---|---|---|---|
| 234,630 | A | * | 11/1880 | Towne | 70/375 |
| 3,402,582 | A | | 9/1968 | Jacobi | |
| 3,429,154 | A | * | 2/1969 | Schwartz | 70/375 |
| 3,935,720 | A | | 2/1976 | Boving | |
| 3,988,912 | A | | 11/1976 | Rogers | |
| 4,290,285 | A | | 9/1981 | Bela et al. | |
| 4,385,510 | A | | 5/1983 | Harper | |
| 4,472,953 | A | * | 9/1984 | Gater | 70/373 |
| 4,631,939 | A | | 12/1986 | Herriott | |
| 4,712,400 | A | | 12/1987 | Steinbach | |
| 4,995,249 | A | | 2/1991 | Preissler et al. | |
| 5,317,889 | A | | 6/1994 | Solovieff et al. | |
| 5,626,041 | A | | 5/1997 | Zaccaria | |
| 6,666,057 | B1 | * | 12/2003 | Huang | 70/375 |
| 6,959,569 | B2 | * | 11/2005 | Strader et al. | 70/492 |
| 7,007,528 | B2 | * | 3/2006 | Chong et al. | 70/492 |
| 2005/0103066 | A1 | | 5/2005 | Botha et al. | |

FOREIGN PATENT DOCUMENTS

| | | |
|---|---|---|
| JP | 11-148257 | 6/1999 |

* cited by examiner

*Primary Examiner*—Suzanne D Barrett
(74) *Attorney, Agent, or Firm*—Carlson, Gaskey & Olds PC

(57) ABSTRACT

A cylinder lock assembly includes a cylinder body and a plug assembly which is manufactured in a multiple of pieces to facilitate casting of each plug piece in a single operation. The plug assembly includes a plug body with a plug insert opening to receive a plug insert. The plug insert opening is generally L-shaped in cross-section to receive the plug insert which is correspondingly shaped. The plug insert includes a plug outer portion which defines an arcuate outer surface which corresponds with the outer circumference of the plug body when the plug insert is mounted therein. A plug pin chamber portion extends generally transverse to the plug outer portion to define a multiple of tumbler pin chambers which extend through the plug outer portion.

23 Claims, 5 Drawing Sheets

MULTI-PIECE PLUG ASSEMBLY FOR A CYLINDER LOCK

BACKGROUND OF THE INVENTION

The present invention relates to a lock assembly, and more particularly to an inexpensively manufactured multi-piece plug assembly.

Numerous types of conventional lock assemblies are utilized for various applications. Some door locksets include a cylinder lock which is typically located in the door operator, such as a knob, or within a guard collar of a deadlock. Such a cylinder lock includes a cylinder body which is formed with a cylindrical opening for receipt of a cylindrically shaped plug for rotation therein. The cylinder body and plug are each formed with a plurality of alignable pin chambers which receive and support sets of spring-biased tumbler pin sets. Normally, various pins overlap a juncture line between adjacent facing surfaces of the cylinder body and the plug to prevent the plug from rotating relative to the cylinder body. This juncture line is referred to as "the shear line."

The plug is formed with a key slot which communicates with the pin chambers so that portions of the tumbler pins extend into the key slot. When an appropriate key is inserted into the slot, bits on the key adjust the position of the tumbler pins so that upper driver pins and lower pins of the pin sets within each pin chamber are moved to locate the interface between the lower pins and the driver pins at the shear line. The shear line is then clear and the plug can be rotated within the opening of the cylindrical body to permit rotation of a driving member and subsequent activation of the lock.

Disadvantageously, the plug may be relatively difficult to manufacture due to the exacting tolerances of the multitude of pin chambers and the keyway which is formed therein. Typically, the plug is cast as a cylinder with the keyway formed therein. Then, the multiple of pin chambers are machined into the plug as a secondary operation. Although effective, this manufacturing process is relatively expensive due to the secondary machine operations.

Accordingly, it is desirable to provide a cylinder lock plug which may be manufactured in an economical manner yet maintain the exacting tolerances required for effective operation.

SUMMARY OF THE INVENTION

A cylinder lock assembly according to the present invention includes a cylinder body and a plug assembly which is manufactured in a multiple of pieces. The plug assembly include a plug body and a plug insert mountable to the plug body. The plug body and plug insert are manufactured as metallic cast components.

The plug body defines a plug insert opening to receive the plug insert from a direction generally transverse to a longitudinal axis. The plug insert opening is generally L-shaped in cross-section to receive the plug insert which is correspondingly shaped.

The plug insert includes a plug outer portion which defines an arcuate outer surface which corresponds with the outer circumference of the plug body when the plug insert is mounted therein. A plug pin chamber portion extends generally transverse to the plug outer portion to define a multiple of tumbler pin chambers in their entirety. The multiple of tumbler pin chambers intersect a plug keyway portion cast within the plug pin chamber portion along the longitudinal axis. The plug insert is shaped to facilitate casting as a single component. Applicant has cast plug inserts which do not require secondary machining operations, yet provide tumbler pin chambers to tolerances which are tighter than those having heretofore machined chambers. Such secondary operation avoidance significantly facilitates inexpensive manufacture as each of the plug body and the plug insert need only be cast in a single operation. Furthermore, casting minimizes the requirements for proper indexing of machining fixtures which still further reduces manufacturing expense through yield loss decrease.

The present invention therefore provides a cylinder lock plug which may be manufactured in an economical manner yet maintain the exacting tolerances required for effective operation.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
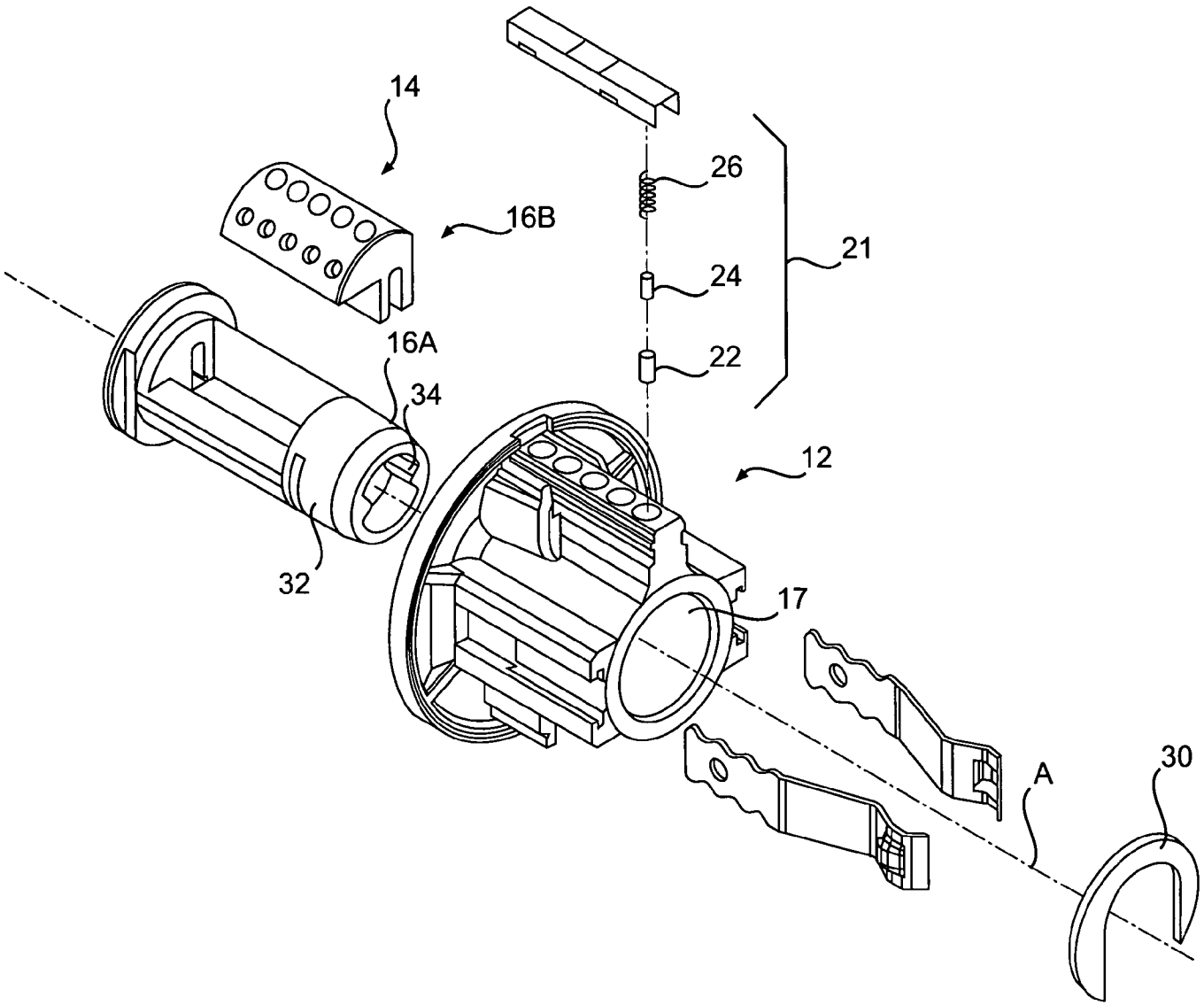
FIG. 1A is an exploded perspective view of a lock assembly for use with the present invention.

FIG. 1A illustrates a general exploded perspective view of a cylinder lock 10. The cylinder lock 10 generally includes a cylinder body 12 and a plug assembly 14. The plug assembly 14 is preferably manufactured in two pieces which include a plug body 16A and a plug insert 16B which is mountable within the plug body 16A. The body 12 and the plug assembly 14 are preferably manufactured as metallic cast components. It should be understood that although a particular component arrangement is disclosed in the illustrated embodiment, other arrangements will benefit from the instant invention.

Figure 1B:
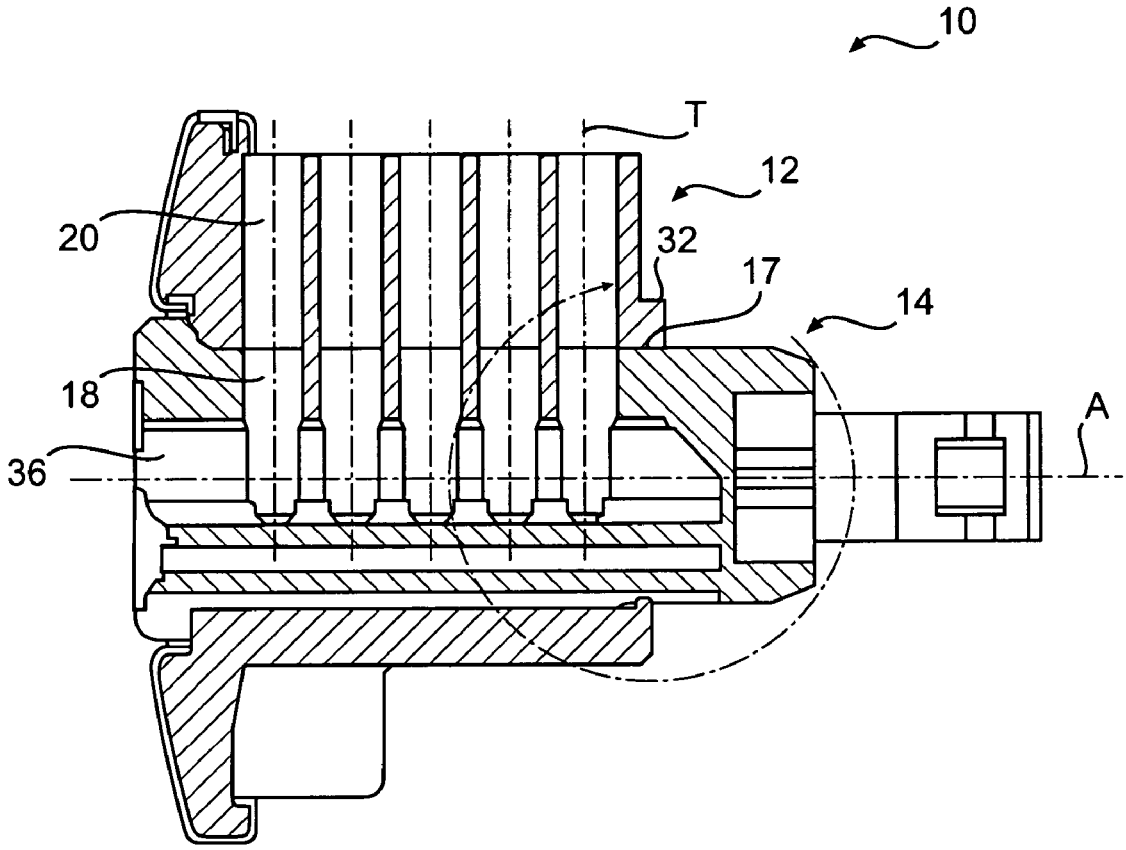
FIG. 1B is a sectional view of the lock assembly of FIG. 1A taken along the longitudinal axis.

Once assembled, the plug assembly 14 is inserted into a cylindrical opening 17 of the cylinder body 12 so that each of a multiple of plug tumbler pin chambers 18 within the plug assembly 14 are aligned with a respective multiple of body tumbler pin chambers 20 within the cylinder body 12 (FIG. 1B). A pin set 21 including a bottom pin 22, a top pin 24 and a spring 26 are positioned within each of the aligned chambers 18, 20. A cover 28 is positioned over the chambers 20 to retain the pin sets 21 therein. A clip 30 is engaged with an inward segment 32 of the plug assembly 14 to rotationally retain the plug assembly 14 within the cylinder body 12 (FIG. 1B).

An actuating member 34 is located adjacent or within the inward segment 32 of the plug to engage a latch actuating assembly (not shown) and subsequent retraction or extension of a bolt or latch to activate the lock in a conventional manner which need not be described in detail herein.

Referring to FIG. 1B, the plug assembly 14 defines a keyway 36 along a longitudinal axis A of the plug assembly 14 to permit insertion of a key which aligns the pin sets 21 relative a shear line such that the plug assembly 14 can be rotated relative the cylinder body 12 to actuate the lock. Operation of the key to pin arrangement may take various conventional forms and need not be described in detail herein.

Figure 2A:
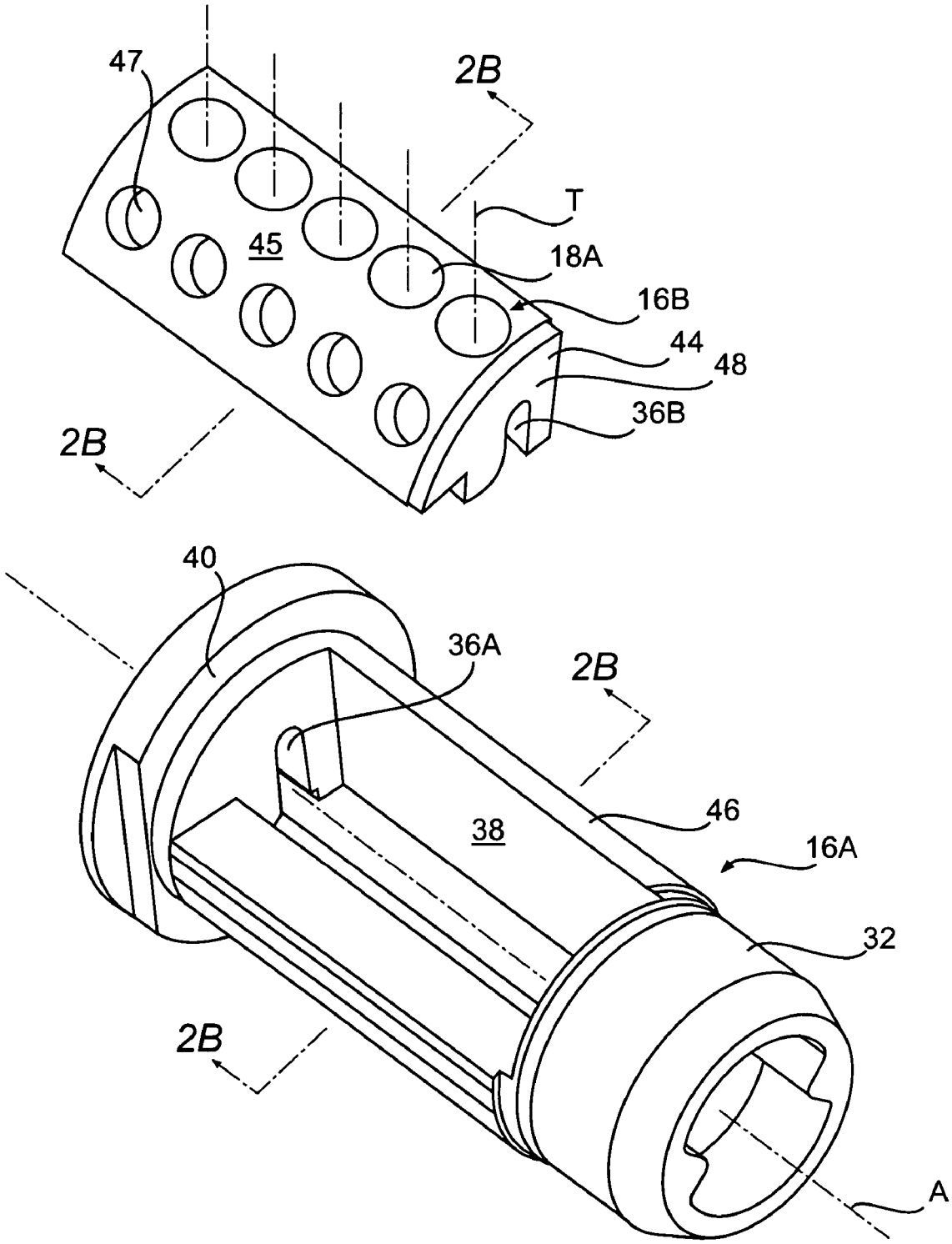
FIG. 2A is an exploded perspective view of a plug assembly according to the present invention.
Figure 2B:
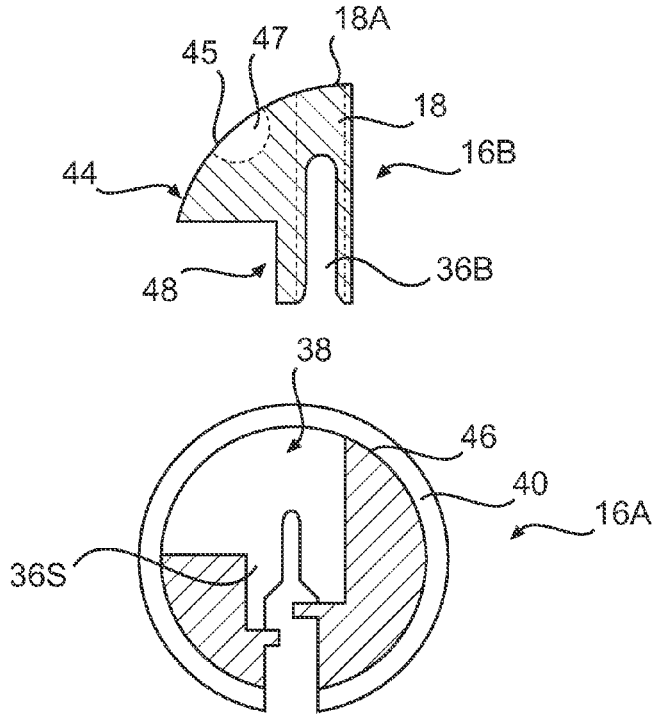
FIG. 2B is a sectional view of the plug assembly of FIG. 2A taken along line 2*b*-2B in FIG. 2A.
Figure 3:
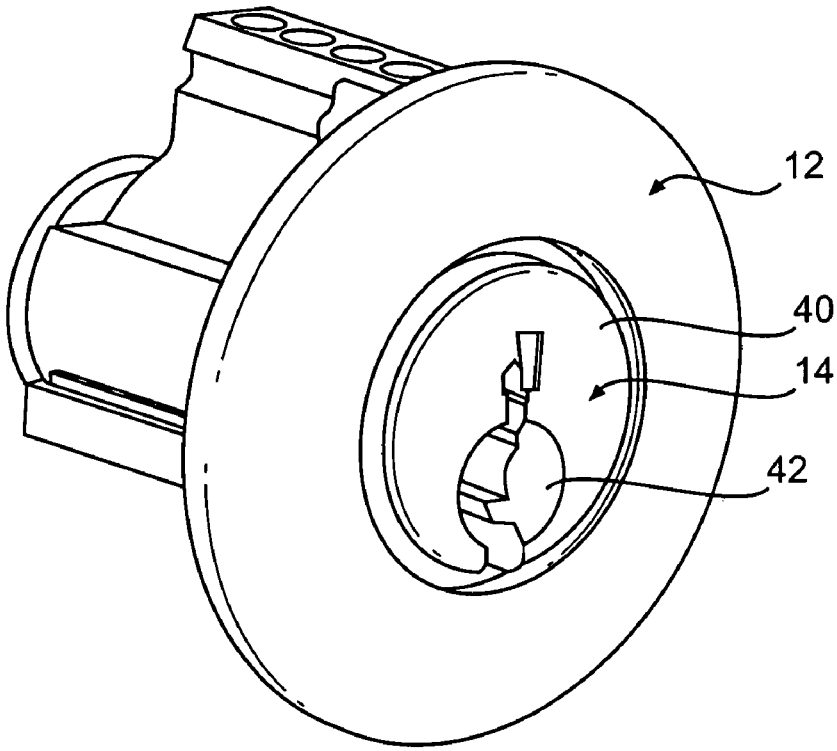
FIG. 3 is a front perspective view of a lock assembly with the plug assembly of the preset invention installed into a lock cylinder.

Referring to FIGS. 2A and 2B, the plug body 16A includes a plug insert opening 38 to receive the plug insert 16B from a direction generally transverse to the longitudinal axis A. The plug insert opening 38 is formed between a plug body outward segment 40 and the inward segment 32. The plug body outward segment 40 defines a keyway opening 42 (FIG. 3) which directs a key into the plug body keyway portion 36A. The plug body keyway portion 36A connects the keyway opening 42 in the plug body outward segment 40 with the plug insert opening 38. Preferably, the plug insert opening 38 is generally L-shaped in cross-section (FIG. 2B) to receive the plug insert 16B which is correspondingly shaped. Notably, the plug body 16A does not include separate plug chambers and is of a relatively uncomplicated tubular shape which readily facilitates molding in a single operation.

Figure 4:
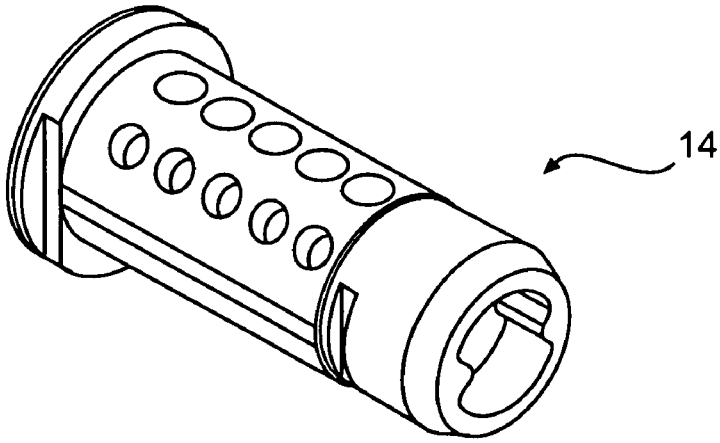
FIG. 4 is a rear perspective view of an assembled plug assembly according to the present invention.

The plug insert 16B includes a plug outer portion 44 which defines an arcuate outer surface 45 which corresponds with the outer circumference 46 of the plug body 16A when the plug insert 16B is mounted therein (FIG. 4). That is, the outer surface 45 of the plug insert 16B completes the outer cylindrical surface of the plug body 16A. The arcuate outer surface 45 includes the outermost openings 18*a* of the tumbler pin chambers 18 to interface with and receive the pins sets 21 (FIG. 1A) from the body tumbler pin chambers 20 within the plug cylinder 14.

The arcuate outer surface 45 may include pattern key "PK" ball receiving pockets 47 adjacent the outermost openings 18*a* to receive the PK balls as generally understood. The PK pockets 47 are preferably located in a segment of the plug outer portion 44 which extends in a cantilever manner from a plug pin chamber portion 48. That is, the multiple of tumbler pin chambers 18 extend through the arcuate outer surface 45 of the plug outer portion 44 and through the plug pin chamber portion 48 while the PK pockets are recesses in the plug outer portion 44 but do not extend through the plug outer portion 44 or into plug pin chamber portion 48.

Generally transverse to the outer plug portion 44, is the plug pin chamber portion 48 such that the plug insert 16B is of a generally "L" shape which corresponds with the plug insert opening 38 (FIG. 2B). In other words, the plug pin chamber portion 48 is the long leg of the "L" shape while the plug outer portion 44 includes the arcuate outer surface 45 and forms the short leg of the "L" shape.

Figure 2C:
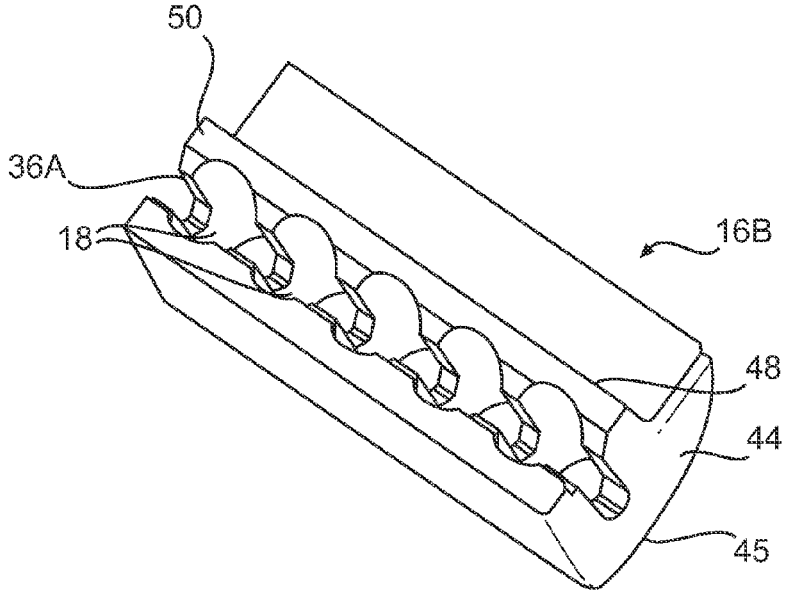
FIG. 2C is a perspective bottom view of a plug insert of the plug assembly of FIG. 2A.

The plug pin chamber portion 48 defines the multiple of tumbler pin chambers 18 in their entirety. That is, the entire bore of each tumbler pin chamber portions 48 is located in the plug insert 16B. The plug pin chamber portion 48 extends along the longitudinal axis A. The multiple of tumbler pin chambers 18 each includes a tumbler pin chamber axis T that is transverse to and intersects the longitudinal axis A (also illustrated in FIG. 1B). The multiple of tumbler pin chambers 18 intersect the plug keyway portion 36B formed within the plug pin chamber portion 48 along the longitudinal axis A. The keyway portion 36B is preferably open along the longitudinal length of the plug pin chamber portion 48 on a bottom side 50 thereof to form a general U-shaped slot with the tumbler pin chambers 18 formed at intervals there along (FIG. 2C). The open bottom side 50 of the plug pin chamber 48 aligns with a slot 36S (FIG. 2B) formed in the plug body 16A when the plug insert 16B is located therein. The slot 36S also forms a portion of the keyway.

The plug insert 16B preferably defines the multiple of tumbler pin chambers 18 and the plug keyway portion 36B in an arrangement which facilitates casting as a single component. In fact, Applicant has cast plug inserts 16B which do not require secondary machining operations, yet provide tumbler pin chambers 18 to dimensional tolerances which are tighter than those with heretofore machined chambers. Such secondary operation avoidance significantly facilitates inexpensive manufacture as each of the plug body 16A and the plug insert 16B need only be cast in a single operation. Furthermore, casting minimizes the requirements for proper indexing of machining fixtures which still further reduces manufacturing expense through yield loss decrease.

It should be understood that relative positional terms such as "forward," "aft," "upper," "lower," "above," "below," and the like are with reference to the normal operational attitude of the vehicle and should not be considered otherwise limiting.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A lock cylinder plug assembly comprising:

a plug body which defines a plug body keyway portion along a longitudinal axis and a plug insert opening; and a plug insert mountable within said plug insert opening, said plug insert defining a multitude of tumbler pin chambers, each of said multitude of tumbler pin chambers defining a complete circular opening through an outer surface which corresponds with an outer circumference of said plug body.

2. The lock cylinder plug assembly as recited in claim 1, wherein said multitude of tumbler pin chambers intersect a plug insert keyway portion formed within said plug insert.

3. The lock cylinder plug assembly as recited in claim 2, wherein said multitude of tumbler pin chambers and said plug insert keyway portion intersect with a contiguous opening within a bottom face of said plug insert.

4. The lock cylinder plug assembly as recited in claim 3, wherein said bottom face is received adjacent to a bottom of said plug insert opening within said plug body.

5. The lock cylinder plug assembly as recited in claim 1, wherein each of said multitude of tumbler pin chambers defines a tumbler axis which intersects said longitudinal axis.

6. The lock cylinder plug assembly as recited in claim 5, wherein said plug insert keyway portion and said plug body keyway portion are defined along said longitudinal axis.

7. The lock cylinder plug assembly as recited in claim 1, wherein said plug insert includes a plug pin chamber portion transverse to an outer plug portion, said outer plug portion defining said outer surface.

8. The lock cylinder plug assembly as recited in claim 7, wherein said outer surface includes an arcuate outer surface which corresponds with said outer cylindrical circumference of said plug body.

9. The lock cylinder plug assembly as recited in claim 7, wherein said plug pin chamber portion and said outer plug portion fits at least partially within said plug insert opening.

10. The lock cylinder plug assembly as recited in claim 7, wherein said plug pin chamber portion is contained within said plug insert opening.

11. The lock cylinder plug assembly as recited in claim 7, wherein said plug pin chamber portion and said outer plug portion form a generally "L" shape in a cross-section transverse to said longitudinal axis which fits within said plug insert opening so that said arcuate outer surface of said outer plug portion corresponds with said outer cylindrical circumference of said plug body such that assembly of said plug body and said plug insert form an essentially continuous cylindrical outer surface.

12. The lock cylinder plug assembly as recited in claim 1, wherein said plug body and said plug insert are cast metal components.

13. The lock cylinder plug assembly as recited in claim 1, wherein each of said multitude of tumbler pin chambers is each cast with a contiguous inner bore perimeter within said plug insert.

14. A lock cylinder assembly comprising:

a cylinder body which defines a cylindrical opening, said cylinder body defining a multitude of body tumbler pin chambers;

a plug body which defines a plug body keyway portion along a longitudinal axis and a plug insert opening; and a plug insert mountable within said plug insert opening to form a generally cylindrical plug assembly mounted for rotation within said cylindrical opening, said plug insert defining a plug insert keyway portion in communication with said plug body keyway portion, said plug insert defining a multitude of tumbler pin chambers, each of said multitude of tumbler pin chambers defining a complete circular opening through an arcuate outer surface which corresponds with an outer circumference of said plug body.

15. The lock cylinder assembly as recited in claim 14, wherein said plug insert and said plug insert opening form a generally "L" shape in a cross-section transverse to said longitudinal axis.

16. The lock cylinder assembly as recited in claim 14, wherein said plug insert defines an outer plug portion with said arcuate outer surface transverse to a plug pin chamber portion, said outer plug portion and said plug pin chamber portion defines said multitude of tumbler pin chambers which intersect said plug insert keyway portion formed within said plug pin chamber portion.

17. A method of manufacturing a plug assembly for a lock cylinder comprising the steps of:

(1) casting a plug body to form a plug body keyway portion along a longitudinal axis and a plug insert opening;

(2) casting a plug insert having a multitude of tumbler pin chambers cast therein, each of the multitude of tumbler pin chambers defining a complete circular opening through an arcuate outer surface which corresponds with an outer circumference of the plug body; and (3) assembling the plug insert into the plug insert opening to form a plug assembly.

18. A method as recited in claim 17, wherein said step (1) includes:

(a) casting the plug body as a generally cylindrical member having a plug body outward segment with the plug body keyway opening in communication with the plug insert opening through the plug body keyway portion.

19. A method as recited in claim 17, wherein said step (2) includes:

(a) casting a plug insert keyway portion into the plug insert, the plug insert keyway portion intersecting the multitude of tumbler pin chambers.

20. A method as recited in claim 17, further comprising the steps of:

(4) sliding the plug assembly into a cylindrical opening of a cylinder body along said longitudinal axis.

21. A lock cylinder plug assembly comprising:

a generally cylindrical plug body which defines a plug body keyway portion along a longitudinal axis and a plug insert opening; and a plug insert forming a generally "L" shape in a cross-section transverse to said longitudinal axis, said plug insert mountable within said plug insert opening, said plug insert having an arcuate outer surface which corresponds with an outer circumference of said generally cylindrical plug body, said plug insert defining a multitude of tumbler pin chambers, each of said multitude of tumbler pin chambers defining a complete circular opening through said arcuate outer surface.

22. The lock cylinder plug assembly as recited in claim 21, further comprising a multiple of pattern key "PK" ball receiving pockets recessed into said arcuate outer surface.

23. The lock cylinder plug assembly as recited in claim 21, wherein said plug insert includes a plug outer portion which extends in a cantilever manner from a plug pin chamber portion to form said generally "L" shape, said multiple of tumbler pin chambers extend through the arcuate outer surface of said plug outer portion.

* * * * *